United States Patent [19]

Foust

[11] 4,332,064

[45] Jun. 1, 1982

[54] BODY SUPPORT FRAME FOR A CASKET

[76] Inventor: Robert K. Foust, 301 Mary Kay, Connersville, Ind. 47331

[21] Appl. No.: 231,374

[22] Filed: Feb. 4, 1981

[51] Int. Cl.[3] ..... A61G 17/00

[52] U.S. Cl. ..... 27/12

[58] Field of Search ..... 27/2, 12

[56] References Cited

U.S. PATENT DOCUMENTS

| | | | |
|---|---|---|---|
| 1,934,425 | 11/1933 | Harms | 27/2 |
| 3,539,142 | 11/1970 | Morand | 27/12 X |
| 3,653,104 | 4/1972 | Nelson | 27/12 |
| 4,044,435 | 8/1977 | Acton | 27/2 |
| 4,047,767 | 9/1977 | Foust | 308/3.6 |

*Primary Examiner*—John D. Yasko

*Attorney, Agent, or Firm*—Woodard, Weikart, Emhardt & Naughton

[57] ABSTRACT

A uniquely constructed body support frame for a casket. Support members include generally "N" shaped rails of cold rolled steel. Longitudinal support members include two such "N" shaped rails, adjoined at interfacing vertical sections, and are bowed along their length. Corner braces connect between the longitudinal support members and transverse support members. The transverse head and foot support members attach to standard mounting apparatus in a tab in groove construction.

19 Claims, 7 Drawing Figures

BODY SUPPORT FRAME FOR A CASKET

BACKGROUND OF THE INVENTION

1. Field of the Invention

The field of the invention is frames for support of a human body in a prone position, more particularly such frames for supporting a corpse in a casket.

2. Description of the Prior Art

Numerous types of body support frames have been used for the purpose of supporting a corpse within a casket. In some instances, the body support frame is an integral part of the casket construction, as is shown in U.S. Pat. No. 4,044,435 issued to Acton. More typically, the body support frame is supported within the casket by adjustable apparatus which can be utilized to position the corpse in desired positions for display and for burial. U.S. Pat. No. 3,653,104 issued to Nelson; U.S. Pat. No. 3,539,142 issued to Morand and U.S. Pat. No. 1,934,425 issued to Harms show various types of adjustable supporting apparatus. The actual body support frames are typically manufactured out of angle iron and have a steel spring suspension, as is illustrated in the Nelson patent.

SUMMARY OF THE INVENTION

In general terms, the present invention provides uniquely constructed body support frames for caskets. Certain embodiments include generally "N" shaped rail sections of cold rolled steel with the longitudinal sections being bowed along their length.

It is an object of the present invention to provide a body support frame for a casket which is light in weight, yet strong enough to support the heaviest of corpses.

It is a further object of the present invention to provide such a body support frame that presents economies of manufacture in material savings and in assembly.

These and other objects of the present invention will become apparent from a reading of the following disclosure.

DESCRIPTION OF THE PREFERRED EMBODIMENT

Figure 1:
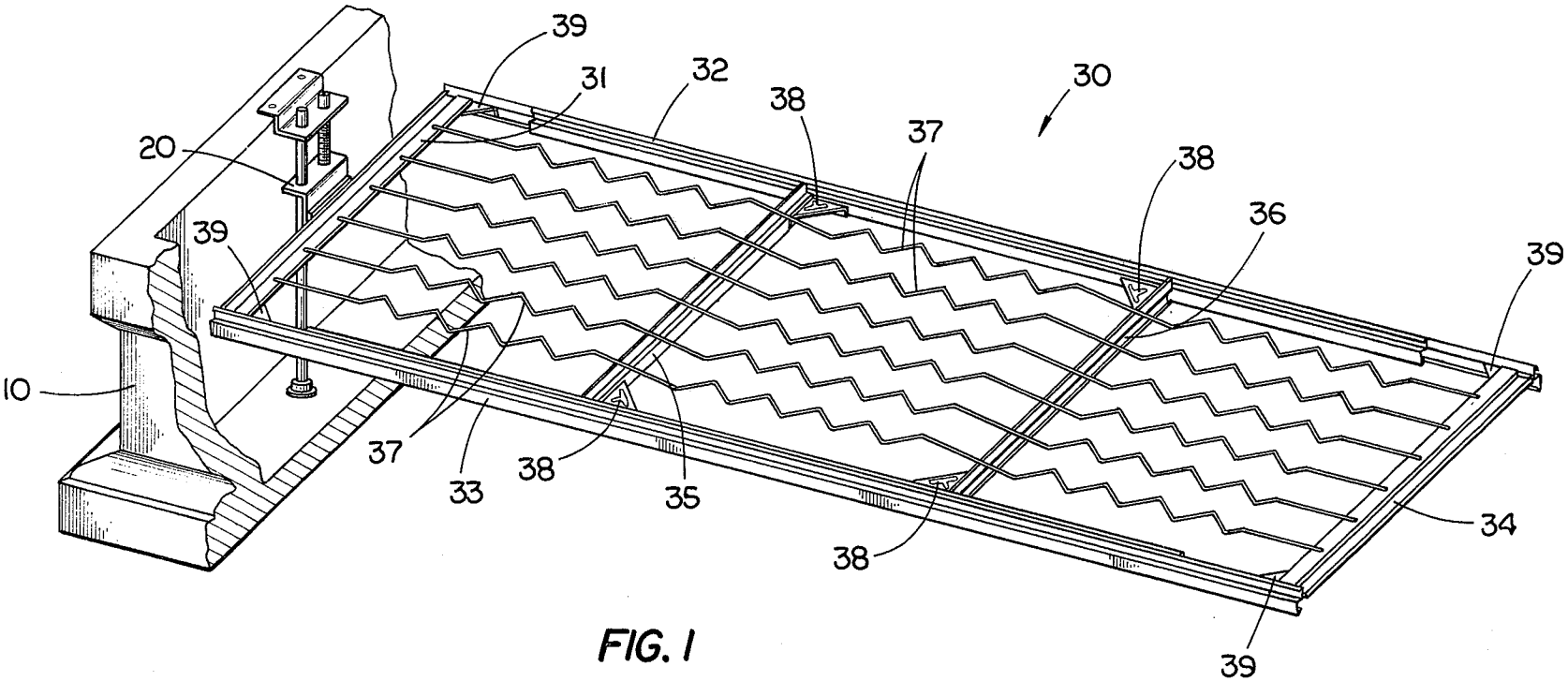
FIG. 1 is a perspective view of a body support frame of the present invention mounted in a casket, with the casket being shown in a cut away fashion.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 illustrates a cut away view of a casket 10, with an adjustable mounting assembly 20 and a support frame 30 mounted thereto. Support frame 30 includes a transverse head frame member 31, two longitudinal side frame members 32 and 33, and a transverse foot frame member 34. Support frame 30 additionally includes two transverse cross frame members 35 and 36 and a spring suspension of spring wires 37 which extend from head frame member 31 to foot frame member 34. At the intersections between longitudinal side frame members and transverse side frame members are corner braces 38, and at the intersections between longitudinal side frame members, and the head frame and foot frame members 31 and 34 are corner braces 39.

Figure 2:
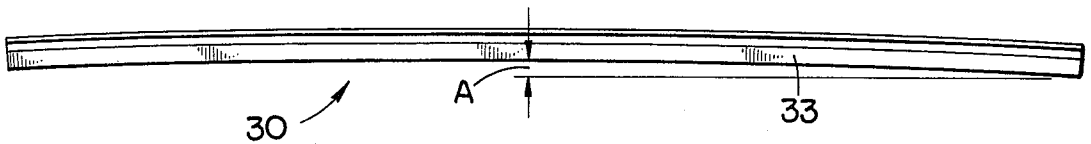
FIG. 2 is a side elevational view of the body support frame of FIG. 1.

In FIG. 2, it can be seen that longitudinal side frame members 32 and 33 are bowed, with the middle portions being a distance A higher than the end portions of the frame members. In the preferred embodiment, the distance A is about one inch. This bowing provides additional strength, allowing support frame 30 to support additional body weight. The bowing also gives additional tensioning to spring wires 37, thus giving the frame additional springiness which is a desirable feature.

Figure 3:
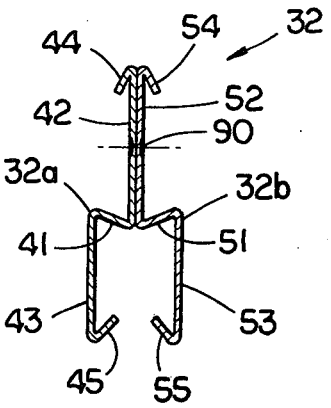
FIG. 3 is a cross-sectional view of one of the side support members of the frame of FIG. 1.

FIG. 3 is a cross sectional view of longitudinal side frame member 32. Member 32 includes two generally "N" shaped rails of cold rolled steel **32*a* and 32*b*. "N" shaped rail 32*a* includes vertical sections 42 and 43 joined by a central section 41. Central section 41 is short relative to the length of vertical sections 42 and 43, thus giving the "N" shape an elongated appearance. Rail 32*a* additionally has flanges 44 and 45, which extend from the distal ends of the vertical sections 42 and 43 respectively. Flanges 44 and 45 extend generally inwardly towards central section 41 and towards each other. In the preferred embodiment, the angle of bend between central section 41 and vertical sections 42 and 43 is about 70°. Also, it is preferred that the angle of bend between flanges 44 and 45, and vertical sections 42 and 43** respectively is about 30°.

Likewise, rail **32*b* is generally "N" shaped. (Although rail 32*b* has the appearance of an inverted "N" as seen in FIG. 3, when viewed from the opposite direction rail 32*b* has the "N" shaped appearance and rail 32A is inverted). Rail 32*b* has vertical sections 52 and 53 and central section 51 which is short relative to vertical sections 52 and 53. Rail 32*b* also has flanges 54 and 55 which extend from the distal ends of vertical sections 52 and 53 respectively, extending generally inwardly towards central section 51 and towards each other. Rails 32*a* and 32*b* are attached to each other by spot welds 90** periodically spaced along the length of the rails.

Figure 4:
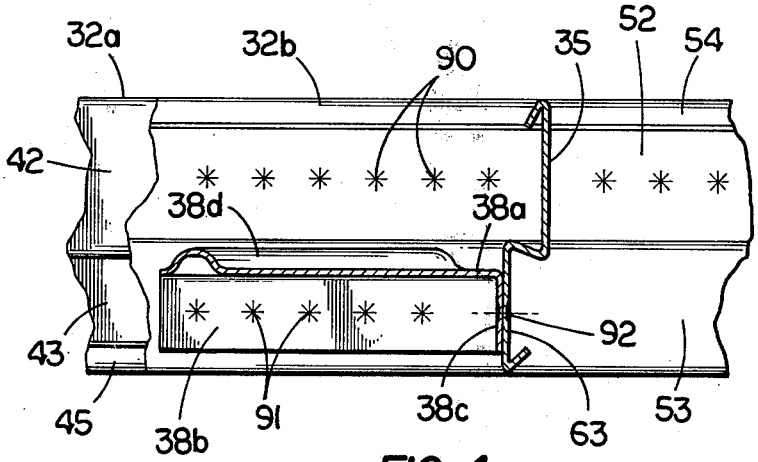
FIG. 4 is a fragmentary, side elevational view of a side support member of the frame of FIG. 1, also showing a cross-sectional view of a cross support member of the frame of FIG. 1, and a partially sectioned view of a corner support of the frame.

FIG. 4 shows the intersection between longitudinal side frame member 32 and cross support member 35. Cross support member 35 has the same general "N" shape as rails 32*a* and 32*b*. Corner brace 38 includes a triangular horizontal plate 38*a* and vertical plates 38*b* and 38*c*. Vertical plates 38*b* and 38*c* abut against, and are spot welded at periodic intervals to vertical sections 53 and 63 respectively (welds 91 and 92 respectively). Horizontal plate 38*a* includes a T-shaped crimp 38*d* which provides additional support.

Figure 5:
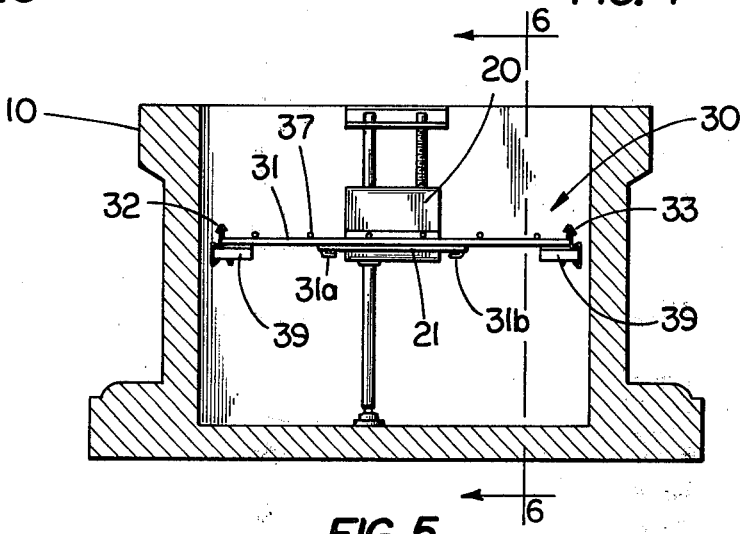
FIG. 5 is an end view of the frame of FIG. 1 mounted to a frame support, with the casket of FIG. 1 being shown in cross-sectional fashion.
Figure 6:
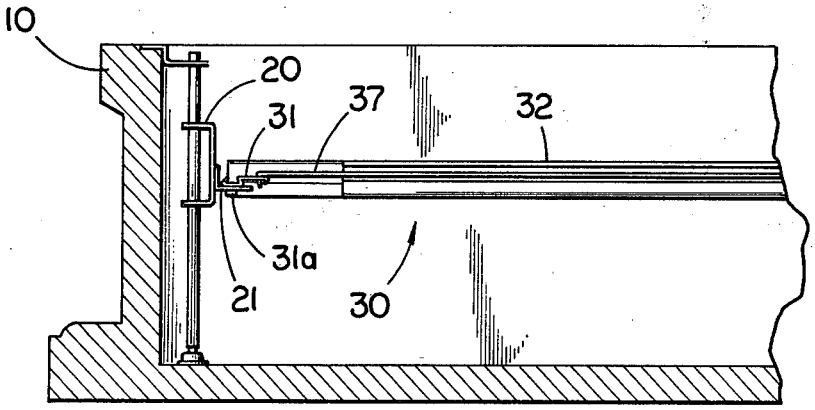
FIG. 6 is a side view of the frame of FIG. 1 mounted in casket 10 and sectioned along line 6—6.

In FIGS. 5 and 6, the attachment between head support member 31 and adjustable mounting apparatus 20 can be seen. Head support member 31 has the same general "N" shape as rails 32*a* and 32*b*, positioned sideways giving the appearance of an elongated "Z" (see FIG. 6). Tabs 31*a* and 31*b* project downwardly from head support member 31 and into slots in horizontal plate 21 of adjustable mounting apparatus 20. Tabs 31*a* and 32*b* are bent over to make a secure attachment to the mounting apparatus. Foot support member 34 is attached to a mounting apparatus in the same fashion.

Figure 7:
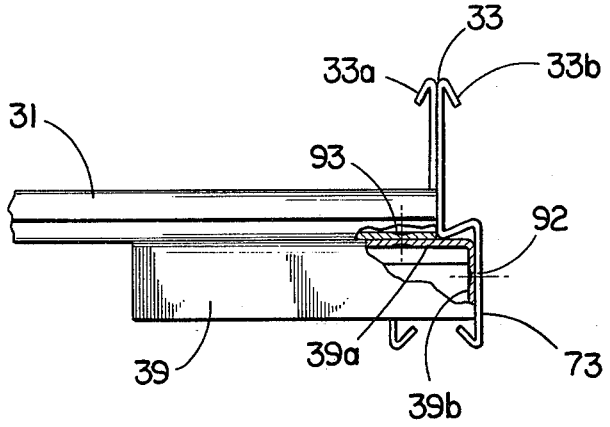
FIG. 7 is a fragmentary end view of the body support frame of FIG. 1, with a cut away portion showing the attachment between a head frame member, a corner brace, and a longitudinal side frame member.

FIG. 7 shows the manner of attachment of corner brace 39 to head frame member 31 and side frame member 33. Spot welds 93 connect between horizontal plate 39*a* of corner brace 39 and head frame member 31. Spot welds 94 connect between vertical plate 39*b* of corner brace 39 and vertical section 73 of side support member 33.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A body support frame for a casket comprising:

(a) two longitudinal side frame members, said side frame members each including a generally "N" shaped rail of cold rolled steel, (b) transverse support members, including transverse head frame and foot frame members, said transverse support members connecting said longitudinal side frame members at said vertical sections of said "N" shaped rails, and (c) spring suspension means, said spring suspension means extending between said transverse head frame and said foot frame members.

2. The body support frame of claim 1 in which the central section of said "N" shaped rails is short relative to the vertical sections of said rails.

3. The body support frame of claim 1 in which said "N" shaped rails additionally include inwardly directing flanges extending from the distal ends of the vertical sections of said rails, said flanges extending generally toward each other.

4. The body support frame of claim 1 in which said longitudinal side frame members are bowed along their length, with the central portions being above the ends of said side frame members.

5. The body support frame of claim 1 in which the vertical differential between the ends of said side frame members and the central portions is about 1 inch.

6. The body support frame of claim 1 in which said longitudinal side frame members each include two "N" shaped rails of each side frame member being connected to each other at facing vertical sections.

7. The body support frame of claim 1 in which said connected "N" shaped rails are symmetrical about the interface between said facing vertical sections.

8. The body support frame of claim 1 in which said facing vertical sections extend upward from their respective central sections.

9. A body support frame for a casket comprising:

(a) two longitudinal side frame members, said side frame members each including a rail of cold rolled steel, said rail including, in cross-section, two vertical section portions and a central section connecting said vertical section portions, with angles of bend between said central section and each of said vertical sections being less than 90°, (b) transverse support members, including transverse head frame and foot frame members, said transverse support members connecting said longitudinal side frame members at said vertical section portions, and (c) spring suspension means, said spring suspension means connecting between said transverse head frame and said foot frame members.

10. The body support frame of claim 9 in which each of said longitudinal side frame members includes two of said rails, said rails being attached to each other at vertical section portions.

11. The body support frame of claim 9 in which the central section of said rails is short relative to the vertical sections of said rails.

12. The body support frame of claim 9 in which said rails additionally include inwardly directing flanges extending from the distal ends of the vertical sections of said rails, said flanges extending generally toward each other.

13. The body support frame of claim 9 in which said longitudinal side frame members are bowed along their length, with the central portions being above the ends of said side frame members.

14. The body support frame of claim 13 in which the vertical differential between the ends of said side frame members to the central sections is about 1 inch.

15. The body support frame of claim 9 in which said longitudinal side frame members each include two of said rails, said rails being connected to each other at facing vertical sections.

16. The body support frame of claim 9 in which said connected rails are symmetrical about the interface between said facing vertical sections.

17. The body support frame of claim 9 in which said facing vertical sections extend upward from their respective central sections.

18. The body support frame of claim 9 in which said transverse support members include rails of cold rolled steel having the same cross-sectional shape as said rails of said longitudinal side frame members.

19. The body support frame of claim 9 additionally including corner braces connecting between said longitudinal side frame members and each of said transverse support members.

* * * * *